US008887337B1

(12) United States Patent
Morris et al.

(10) Patent No.: US 8,887,337 B1
(45) Date of Patent: Nov. 18, 2014

(54) OPERABLE RAMP

(71) Applicants: Donald Morris, Littleton, CO (US); David Johnson, Modesto, CA (US)

(72) Inventors: Donald Morris, Littleton, CO (US); David Johnson, Modesto, CA (US)

(73) Assignee: Lift-U, Division of Hogan Mfg., Inc., Escalon, CA (US)

( * ) Notice: Subject to any disclaimer, the term of this patent is extended or adjusted under 35 U.S.C. 154(b) by 0 days.

(21) Appl. No.: 14/198,160

(22) Filed: Mar. 5, 2014

(51) Int. Cl.
*B66B 9/08* (2006.01)
*B66B 9/06* (2006.01)
*E04F 11/00* (2006.01)

(52) U.S. Cl.
CPC ..... *E04F 11/002* (2013.01); *Y10S 414/134* (2013.01)
USPC ..... 14/71.3; 14/71.1; 414/921; 187/200

(58) Field of Classification Search
USPC ..... 14/71.1, 71.3; 187/200; 414/921
See application file for complete search history.

(56) References Cited

U.S. PATENT DOCUMENTS

| | | | | |
|---|---|---|---|---|
| 4,027,807 | A * | 6/1977 | Thorley | 414/545 |
| 4,081,091 | A * | 3/1978 | Thorley | 414/545 |
| 4,164,292 | A * | 8/1979 | Karkau | 414/545 |
| 4,270,630 | A * | 6/1981 | Karkau | 187/200 |
| 5,454,196 | A * | 10/1995 | Gaines et al. | 52/183 |
| 6,484,344 | B1 * | 11/2002 | Cooper | 14/71.1 |
| 6,764,123 | B1 * | 7/2004 | Bilyard | 296/61 |
| 8,631,529 | B1 * | 1/2014 | Johnson et al. | 14/71.3 |
| 8,739,342 | B1 * | 6/2014 | Johnson et al. | 14/71.3 |

* cited by examiner

*Primary Examiner* — Gary Hartmann
(74) *Attorney, Agent, or Firm* — Christensen O'Connor Johnson Kindness PLLC

(57) ABSTRACT

An operable ramp is moveable between a raised position and a lowered position. In the raised position, the operable ramp forms a step. The operable ramp has a first panel rotatably coupled at a first end about a first axis. The first axis moves in a first direction when the operable ramp moves toward the lowered position and in a second direction when the operable ramp moves toward the raised position. The operable ramp further includes a second panel rotatably coupled at a first end to a second end of the first panel. The first panel and the second panel cooperate to provide an inclined surface when the operable ramp is in the lowered position. A linkage is operably coupled to the first panel to selectively rotate the first panel about the first axis.

18 Claims, 11 Drawing Sheets

OPERABLE RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress.

Installing a fixed ramp is a common way to provide the physically challenged with access to a building with one or more steps at the entrance. Fixed ramps take up a large amount of space and often detract from the aesthetic qualities of the building. Fold out ramps, similar to those used in vehicles can be utilized, but deployment often requires a large area into which the ramp deploys. Accordingly, there is a need for a ramp that provides access to a building with a step at the entrance, while minimizing the space required by the ramp.

SUMMARY

A first exemplary embodiment of an operable ramp is moveable between a raised position and a lowered position. In the raised position, the operable ramp forms a step. The operable ramp has a first panel rotatably coupled at a first end about a first axis. The first axis moves in a first direction when the operable ramp moves toward the lowered position and in a second direction when the operable ramp moves toward the raised position. The operable ramp further includes a second panel rotatably coupled at a first end to a second end of the first panel. The first panel and the second panel cooperate to provide an inclined surface when the operable ramp is in the lowered position. A linkage is operably coupled to the first panel to selectively rotate the first panel about the first axis.

A second exemplary embodiment of an operable ramp is moveable between a raised position and a lowered position. In the raised position, the operable ramp forms a step. The operable ramp includes a first panel rotatably coupled at a first end about a first axis. The first axis moves in a first direction when the operable ramp moves toward the lowered position and in a second direction when the operable ramp moves toward the raised position. A second panel is rotatably coupled at a first end to a second end of the first panel. When the operable ramp is in the lowered position, the first panel and the second panel cooperate to provide an inclined surface. The operable ramp further includes a third panel rotatably associated with the first end of the first panel. The third panel provides a surface between the first panel and a fourth panel.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the presently disclosed operable ramp will now be described with reference to the accompanying drawings, where like numerals correspond to like elements. Exemplary embodiments of the disclosed subject matter are directed to operable ramps, and more specifically, to operable ramps that are selectively moveable between a raised "step" position and a lowered "ramp" position. In particular, several embodiments of the present invention are directed to operable ramps for use in architectural settings such as building entrances in which the indoor and outdoor levels differ, for example, when the building entrance includes a step.

The following discussion proceeds with reference to examples of operable ramps suitable for use at building entrances wherein there is a change in elevation, i.e., a step up or step down. While the examples provided herein have been described with reference to their association with building entrances, it will be apparent to one skilled in the art that this is done for illustrative purposes and should not be construed as limiting the scope of the disclosed subject matter, as claimed. Thus, it will be apparent to one skilled in the art that aspects of the disclosed operable ramp may be employed in a number of architectural settings, wherein a change in elevation, such as a step, provides an obstruction to a person with limited mobility.

The following detailed description may use illustrative terms such as higher, lower, inner, outer, vertical, horizontal, front, rear, proximal, distal, etc.; however, these terms are descriptive in nature and should not be construed as limiting. Further, it will be appreciated that embodiments of the disclosed subject matter may employ any combination of features.

Figure 1:
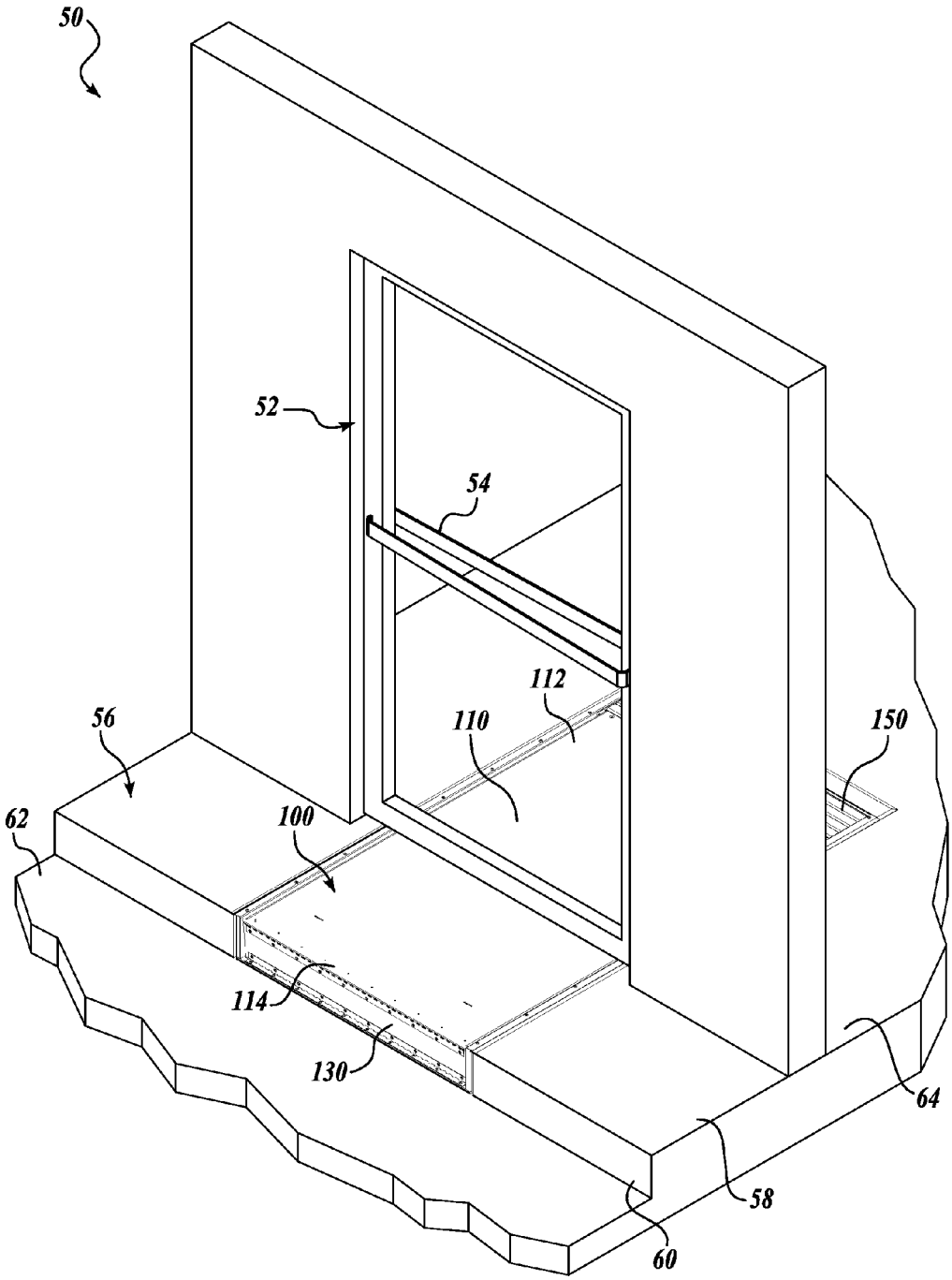
FIG. 1 shows an isometric view of an exemplary embodiment of an operable ramp installed in a doorway of an architectural setting with the operable ramp in a raised position and the door closed.
Figure 2:
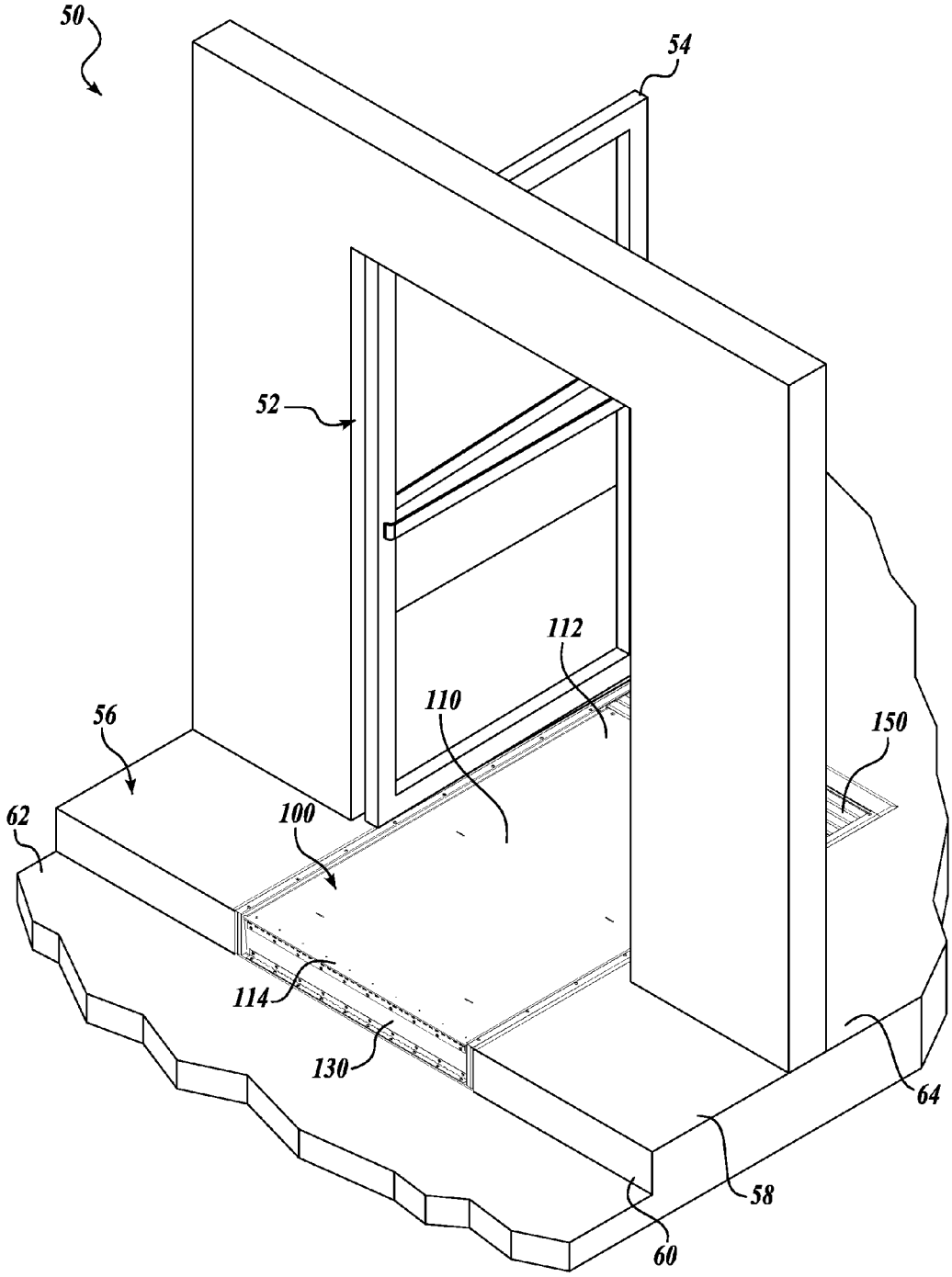
FIG. 2 shows an isometric view of the operable ramp of FIG. 1 with the door open.
Figure 3:
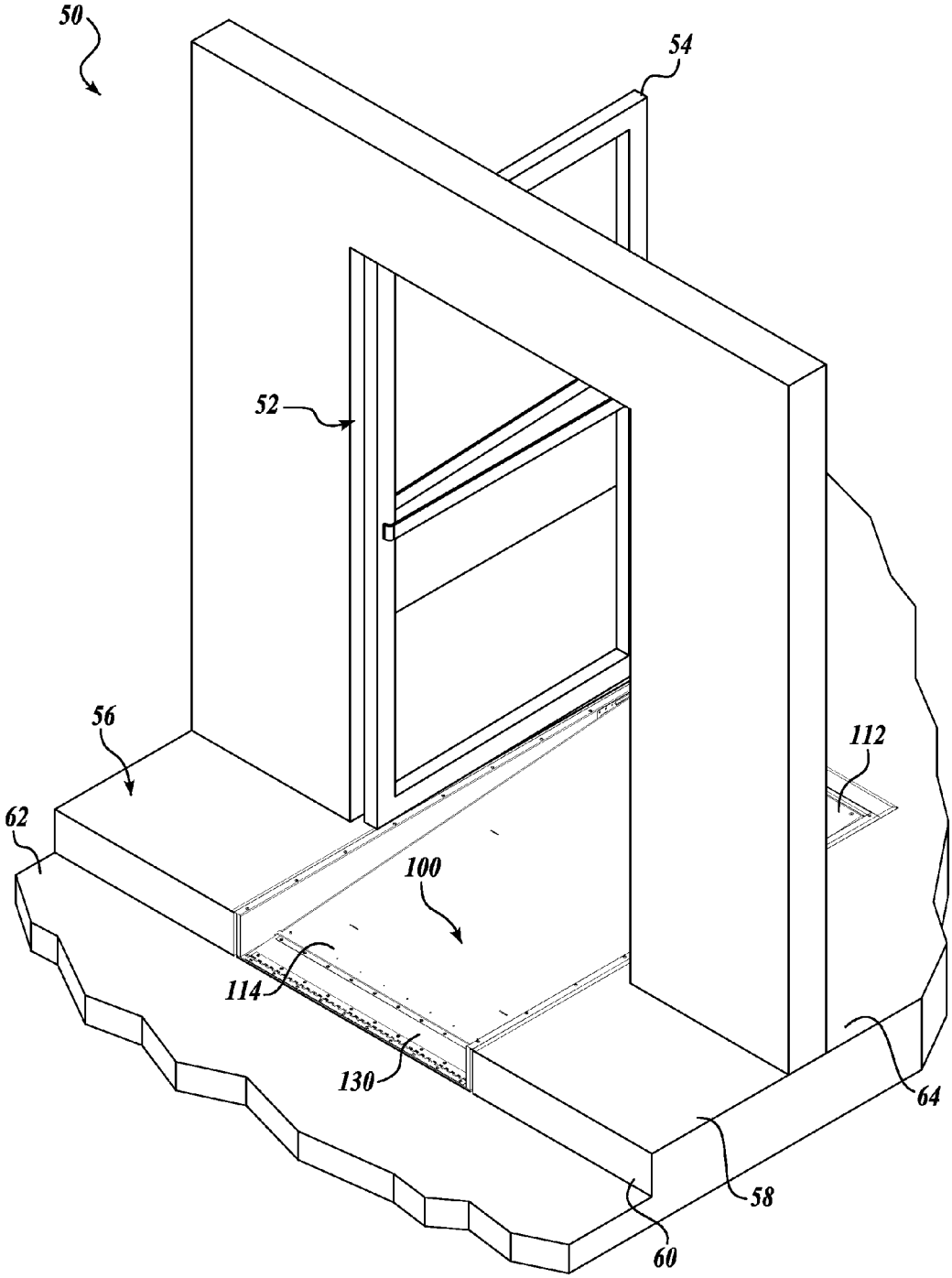
FIG. 3 shows an isometric view of the operable ramp of FIG. 1 in a lowered position.
Figure 4:
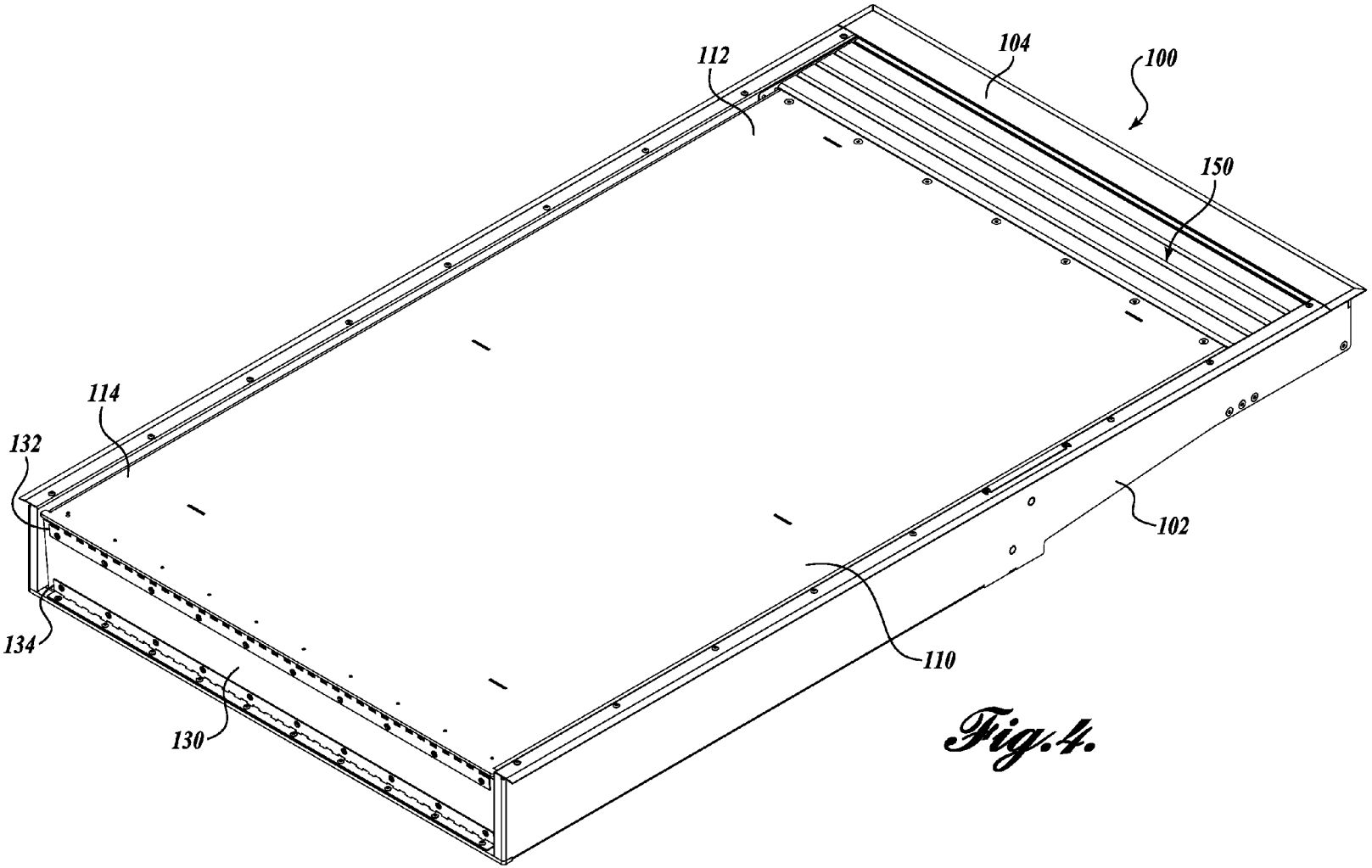
FIG. 4 shows an isometric view of the operable ramp of FIG. 1 in the raised position.
Figure 5:
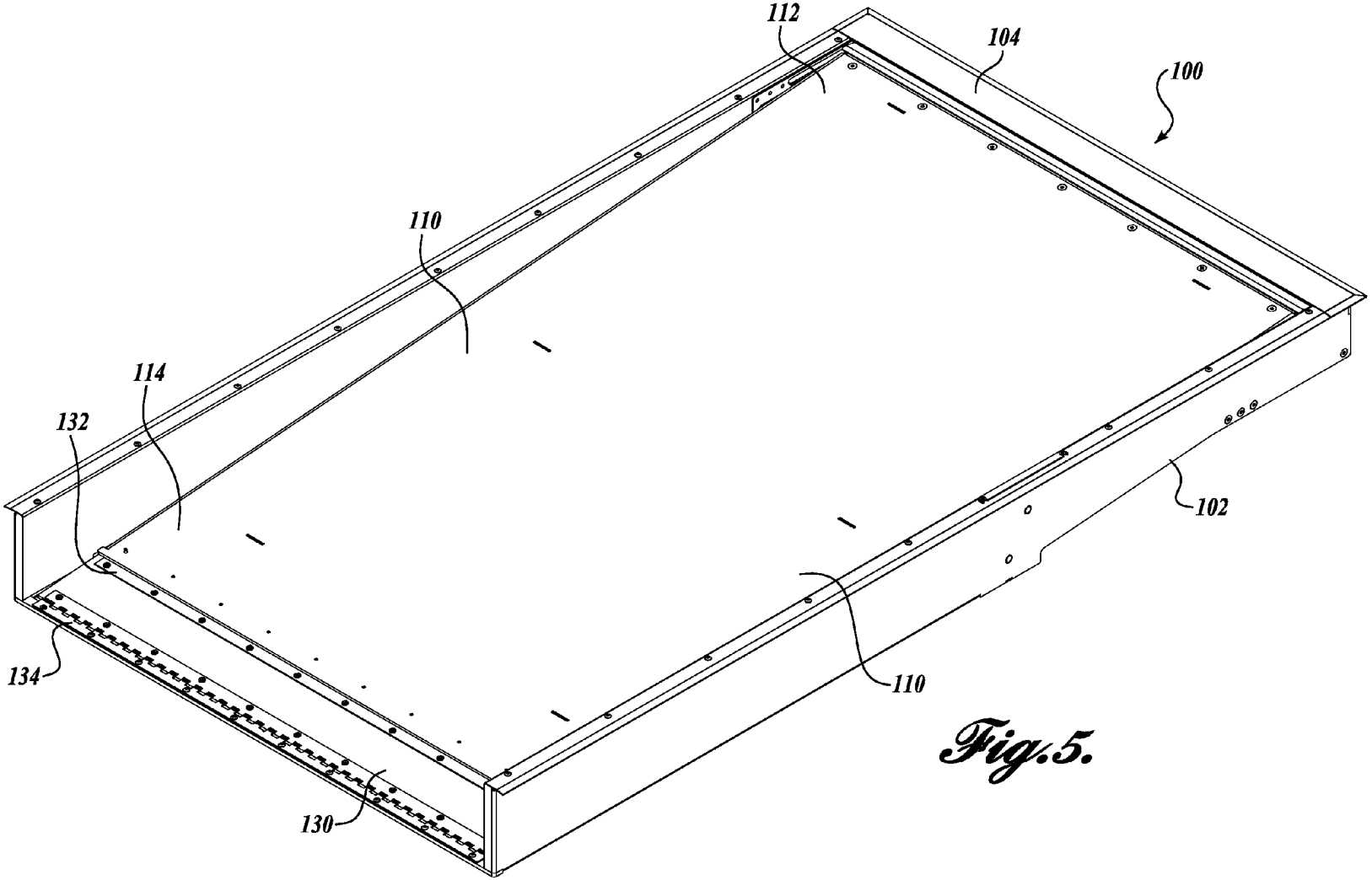
FIG. 5 shows an isometric view of the operable ramp of FIG. 4 in the lowered position.

FIGS. 1-5 show an exemplary embodiment of an operable ramp 100. More specifically, FIGS. 1-3 show the operable ramp 100 shown installed at the entrance 52 of a building 50, and FIGS. 4 and 5 show the same embodiment in isolation, i.e., not installed. Referring to FIGS. 1-3, an exemplary entrance 52 includes a door 54 with a step 56 positioned outside of the door. The step 56 includes a tread portion 58 and a riser portion 60. The tread portion 58 of the step 56 is level with the floor of the building 50 so that a person walking into the building uses the step to step up from a lower first surface 62 outside the building to a higher second surface 64 inside the building. It will be appreciated that the illustrated installation of the operable ramp 100 is exemplary only and should not be considered limiting. In this regard, the operable ramp 100 can be installed in any number of architectural settings having a step that would present an obstacle for a physically challenged person.

The operable ramp 100 includes a first panel 110 coupled to a second panel 130. FIGS. 1 and 4 show the operable ramp 100 in a raised position. In the raised position, the operable ramp 100 forms a step such that the first panel 110 is generally horizontal and flush with the second surface 64, and the second panel extends downward from the outer end 114 of the first panel 110 to the first surface 62. Thus, the first panel 110 acts as a tread, and the second panel 130 forms a riser when the operable ramp 100 is in the raised position. When the operable ramp 100 is in the lowered position of FIGS. 3 and 5, the first panel 110 slopes downward from its inner end 112 to the upper end 132 of the second panel 130, which slopes downward from its upper end 132 to the first surface 62. Thus, the first panel 110 and second panel 130 cooperate to provide a transition surface that extends from the lower first surface 62 to the higher second surface 64 when the operable ramp 100 is in the lowered (ramp) position.

Referring to FIGS. 4 and 5, the operable ramp 100 includes a frame 102. The frame provides a structure with a fixed position to which the components of the operable ramp 100 are attached. To install the operable ramp 100 in an architectural setting, the frame 102 is attached to surrounding structure to secure the operable ramp in place. Although the illustrated embodiments of the operable ramp 100 include a frame 102, other embodiments are contemplated in which the operable ramp 100 does not include a frame. To install such embodiments in architectural settings, the operable ramp 100 components are attached directly to the surrounding structure or to suitable structure within the building, thus making a frame 102 unnecessary. Accordingly, embodiments of the described operable ramp 100 that do not include a frame 102 should be considered within the scope of the present disclosure.

Referring to FIGS. 4, 5, 7, and 8, the first panel 110 is a generally rectangular panel formed of known materials to have suitable strength and durability such that the panel can withstand user traffic in both the raised (step) and lowered (ramp) positions. In one exemplary embodiment, the first panel 110 is formed from one or more pieces of sheet metal (such as aluminum or steel), with a plurality of stiffeners attached to the bottom of the panel to provide additional stiffness. A texture is preferably formed integrally with or applied to the upper surface of the first panel 110 to provide increased traction.

The outer end 114 of the first panel 110 is rotatably coupled to the upper end 132 of the second panel 130 about an axis 300 with a hinge or other suitable structure. Similar to the first panel 110, the second panel 130 is constructed of well-known materials having suitable strength and durability to withstand user traffic in both the raised (step) and lowered (ramp) positions. The lower end 134 of the second panel 130 is rotatably coupled with a hinge or other suitable structure to the frame 102 about an axis 302 that is parallel to axis 300.

Figure 11:
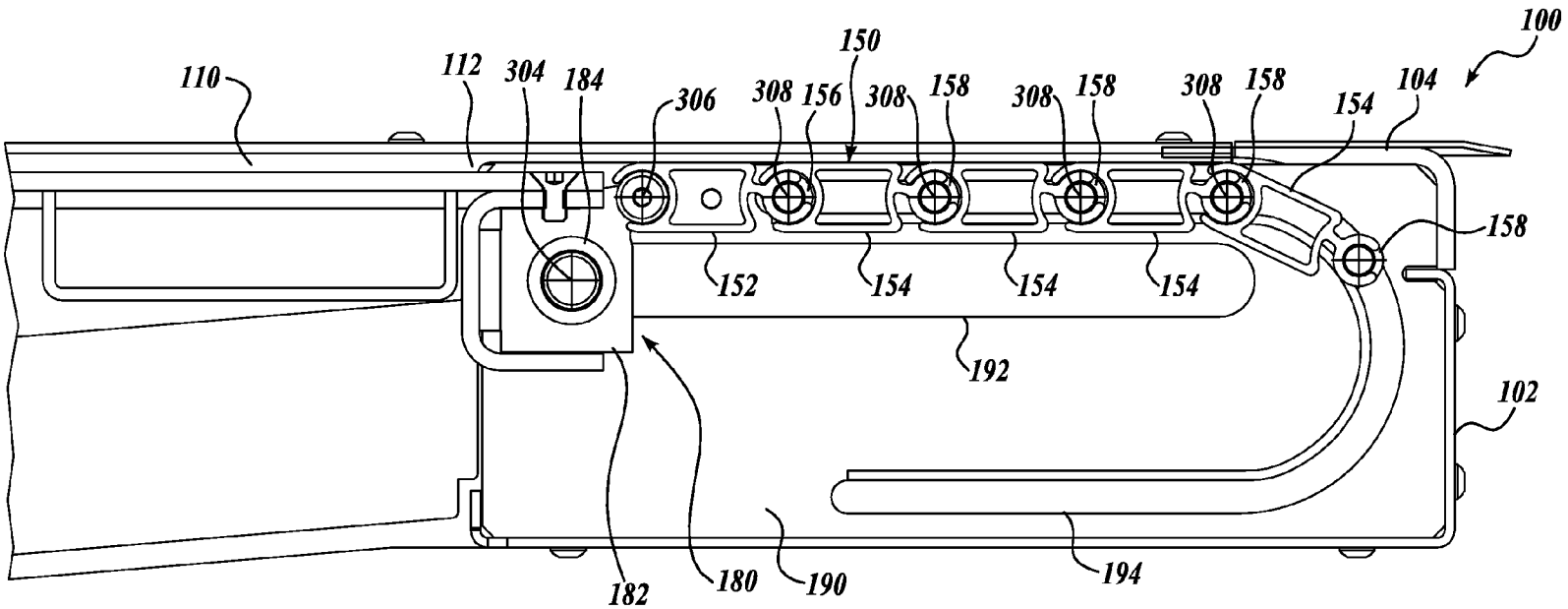
FIG. 11 shows a cutaway side view of a retractable portion of the operable ramp of FIG. 4 with the operable ramp in the raised position.
Figure 12:
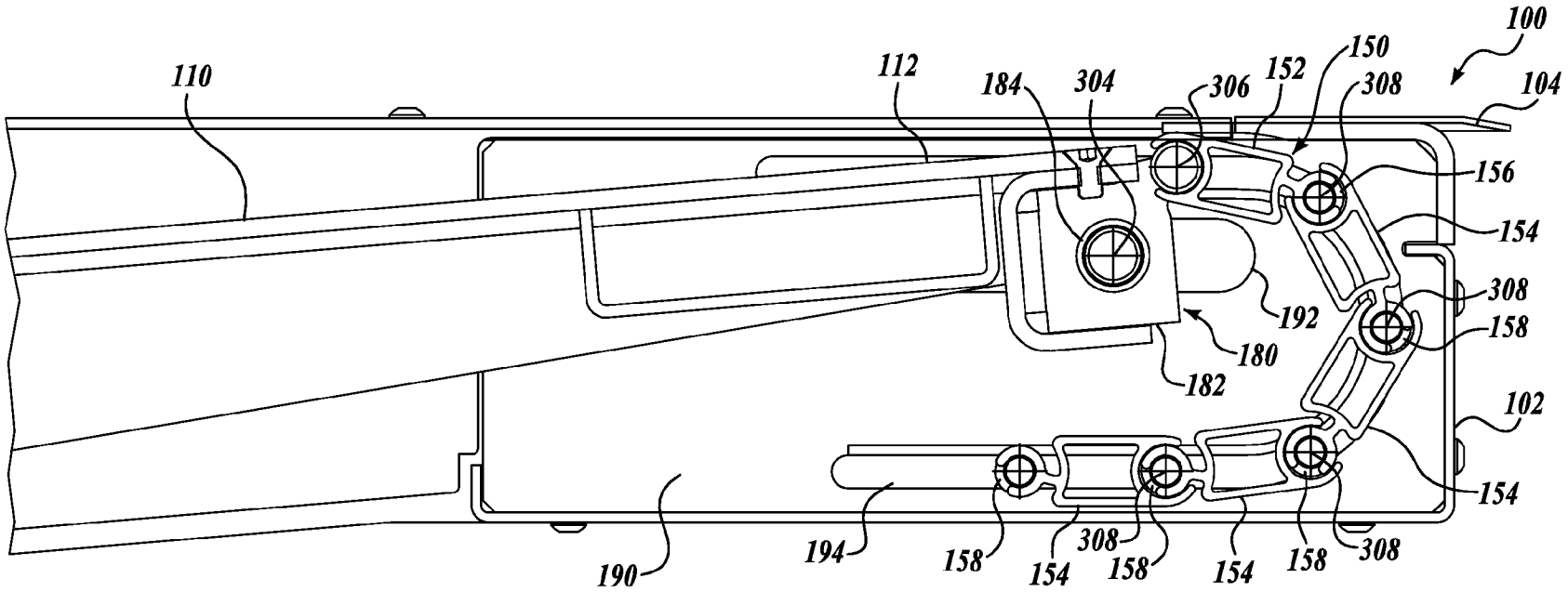
FIG. 12 shows a cutaway side view of the retractable portion of FIG. 11 with the operable ramp in the lowered position.

As shown in FIGS. 11 and 12, the inner end 112 of the first panel 110 is coupled to a pivot block 180. The pivot block 180 includes a block 182 extending approximately the width of the first panel 110. A bearing element 184 extends laterally from each end of the block 182. A guide 190 is coupled to each side of the frame 102 at the inner end of the operable ramp 100.

A horizontal elongate slot 192 is formed in each guide 190. Each elongate slot 192 receives one of the bearing elements 184 of the pivot block 180. The bearing elements 184 are disposed within the elongate slots 192 such that the pivot block 180 and, therefore, the first panel 110 are translatable along the length of the slots. In addition, the pivot block 180 is rotatable relative to the guides 190 about an axis 304. To allow for rotation about axis 304, the bearing elements 184 are rotatable within the elongate slots 192 and/or the bearing elements are rotatable relative to the block 182.

Still referring to FIGS. 11 and 12, a retractable panel 150 is rotatably coupled at one end to the pivot block 180 about an axis 306. In the illustrated embodiment, the retractable panel 150 includes a plurality of cross-members 152 and 154 extending between the guides 190 and oriented to be approximately parallel to the inner edge of the first panel 110. The first cross-member 152 is rotatably coupled to the pivot block 180 about axis 306. The first cross-member 152 includes a bearing element 156 extending laterally from each end of the cross-member.

A U-shaped channel 194 is formed in each guide 190, and each bearing element 156 extends into one of the U-shaped channels. The bearing elements 156 are disposed within the U-shaped channels 194 such that the first cross-member 152 is translatable along the length of the U-shaped channels. In addition, the first cross-member 152 is rotatable relative to the guides 190 about an axis 308. To allow for rotation about axis 308, the bearing elements 156 are rotatable within the U-shaped channels 194 and/or the bearing elements are rotatable relative to the first cross-member 152. Thus, the first cross-member 152 is supported at one edge by the pivot block 180 and at the other edge by the engagement of the bearing elements 156 with the U-shaped channels 194 of the guides 190.

The remainder of the retractable panel 150 is formed by additional cross-members 154 arranged in seriatim, wherein each of the additional cross-members is similar to the first cross member 152. The first of the additional cross-members 154 is rotatably coupled at a first edge to the first cross-member 152 about axis 308. The first additional cross-member 154 is supported at a second edge by bearing elements 158 that extend from each end, each bearing element engaging one of the U-shaped channels 194 formed in the guides 190. Each subsequent cross-member 154 is similarly supported at one edge by rotational attachment about axis 308 to the adjacent cross-member 154 and at a second edge by engagement of the bearing elements 158 with the U-shaped channels 194 of the guides 190. The cross-members 152 and 154 are sized and configured to provide a sufficiently stiff and durable walking surface when the operable ramp 100 is in the raised position and, as will be described in detail, to retract along the length of the U-shaped channels 194 when the operable ramp moves to the lowered position.

Figure 6:
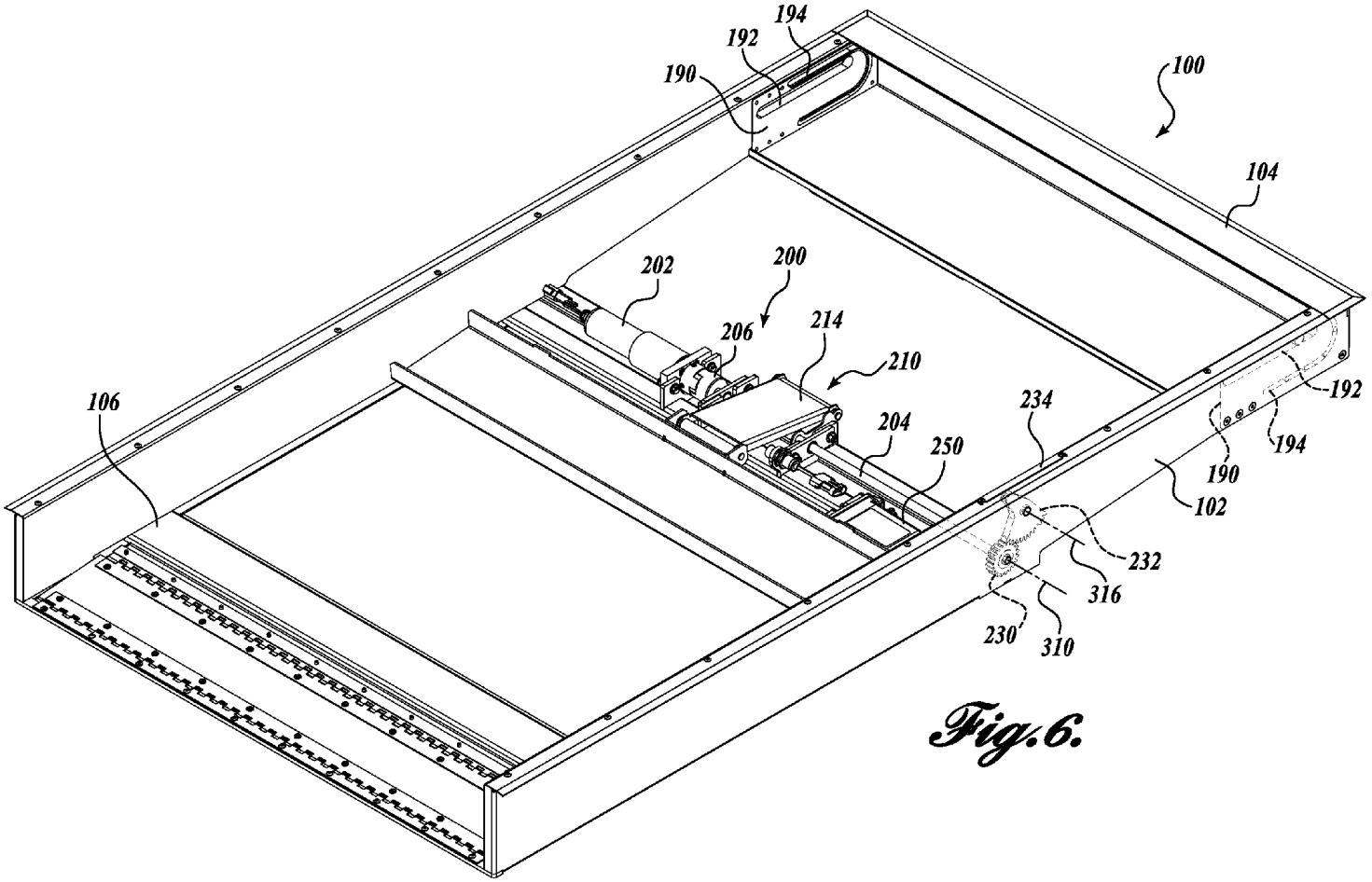
FIG. 6 shows a partially cutaway isometric view of the operable ramp of FIG. 5 in the lowered position.
Figure 9:
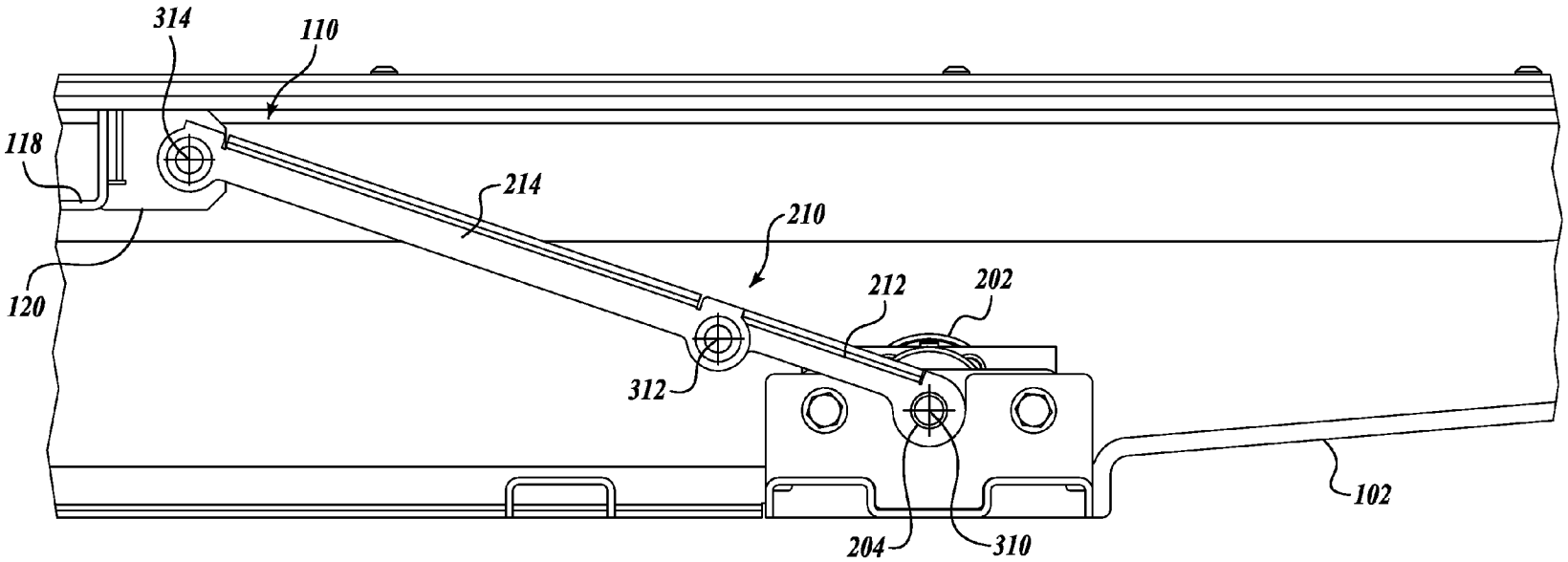
FIG. 9 shows a cutaway side view of a linkage of the operable ramp of FIG. 4 with the operable ramp in the raised position.
Figure 10:
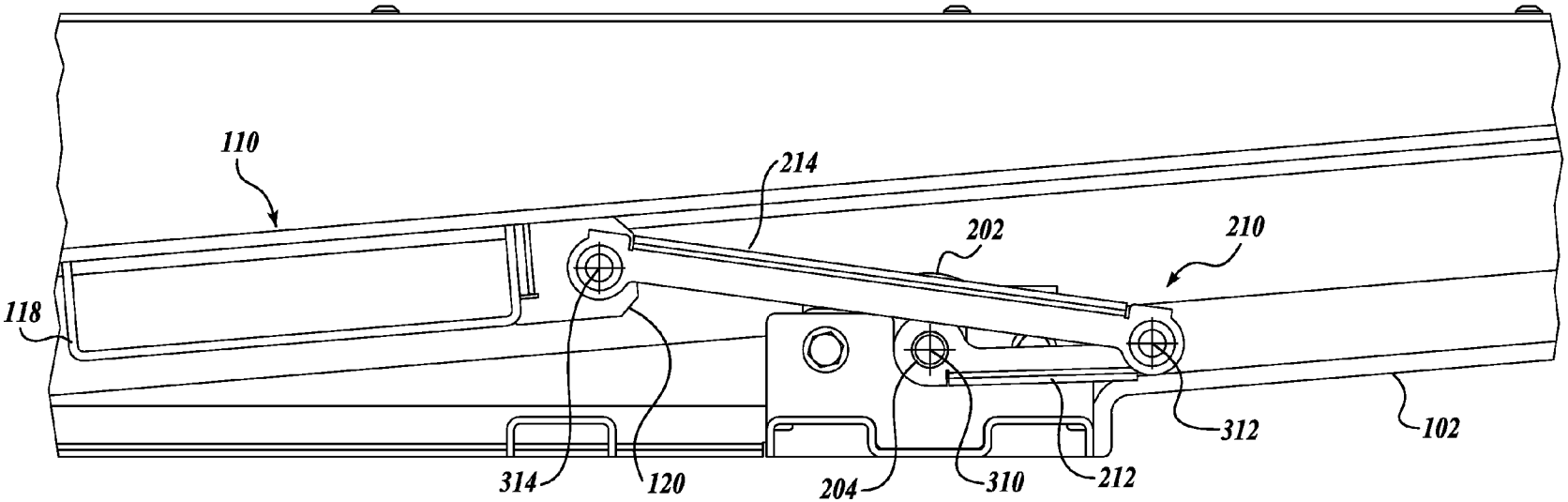
FIG. 10 shows a cutaway side view of the linkage of FIG. 9 with the operable ramp in the lowered position.

Referring now to FIGS. 6, 9, and 10, the operable ramp 100 includes a drive assembly 200 to selectively reciprocate the operable ramp between the raised position and the lowered position. In the disclosed embodiment, the drive assembly 200 includes a motor 202 disposed below the first panel 110. The motor 202 is operably coupled to a drive shaft 204 by a known transmission 206 so that the motor selectively rotates the drive shaft about a fixed axis 310. The drive shaft 204 is coupled to a first end of a drive link 212, which forms part of a linkage 210. Rotation of the drive shaft 204 rotates the drive link 212 about axis 310. A second end of the drive link 212 is rotatably coupled about axis 312 to one end of a slave link 214. A second end of the slave link 214 is rotatably coupled to the first panel 110 about an axis 314. In the illustrated embodiment, the slave link is coupled to a linkage fitting 120 that is secured to a stiffener 118 located on the bottom of the first panel 110; however, it will be appreciated that any suitable configuration for rotatably coupling the slave link to the first ramp can be utilized and should be considered within the scope of the present disclosure.

A controller 250 is operably coupled to the motor 202. The controller 250 receives input from an operator and selectively controls the motor 202 to reciprocate the operable ramp 100 between the raised position and the lowered position. More specifically, the controller 250 controls the motor 202 to rotate the drive shaft 204 in a first direction to move the operable ramp 100 toward the lowered (ramp) position and in a second direction to move the operable ramp toward the raised (step) position.

It will be appreciated that a number of alternate drive assemblies 200 can be utilized to selectively rotate the drive shaft 204 in first and second directions about axis 310. In one alternate embodiment, a linear actuator rotates the drive shaft rather than the disclosed motor with a rotary output. In another contemplated embodiment, the drive assembly 200 includes a counterbalance to reduce the force required to actuate the operable ramp 100, thereby decreasing the size of the motor. These and other configurations that selectively rotate the drive link 212 in first and second directions are contemplated and should be considered within the scope of the present disclosure.

Figure 7:
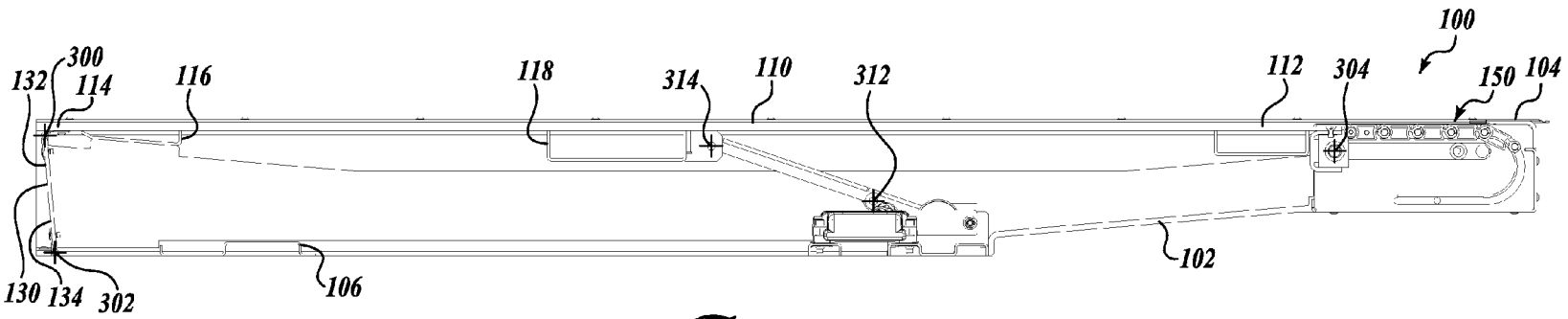
FIG. 7 shows a cutaway side view of the operable ramp of FIG. 4 in the raised position.

As shown in FIG. 7, when the operable ramp 100 is in the raised (step) position, the first panel 110 provides a generally horizontal "tread" portion upon which able bodied persons can walk. The inner end 112 of the first panel 110 is supported by the engagement of the pivot block 180 with the elongate slots 192 formed in the guides 190. The retractable panel 150 extends inwardly from the inner end 112 of the first panel 110 to provide a transition surface between the first panel and a fixed panel 104 positioned at the inner end of the frame 102.

The second panel 130 extends downward from the outer end 114 of the first panel 110 to provide a "riser" to the step. The second panel 130 also supports the outer end 114 of the first panel 110 when the operable ramp 100 is in the raised position. In the illustrated embodiment, the axis 300 between the first and second panels 110 and 130 is offset from the axis 302 between the second panel and the frame 102. As a result, the weight of the first panel tends to rotate the second panel 130 counterclockwise as viewed in FIG. 7. In the event of a power outage or drive system failure, the second panel 130 will tend to rotate in the counterclockwise direction, but will be restrained by the first panel 110, the inner end 112 of which is restrained by the engagement of the pivot block 180 with the outer end of the elongate slots 192. In this manner, the operable ramp 100 is maintained in a raised position, even in the event of a power outage or drive system failure.

To move the operable ramp 100 from the raised position to the lowered position, the motor 202 rotates the drive shaft 204 in a first direction (clockwise as viewed in FIG. 7). The drive shaft 204 rotates the drive link 212 about axis 310, which in turn drives the slave link 214. Movement of the slave link 214 drives the first panel 110 toward the fixed panel 104. As the first panel 110 moves toward the fixed panel 104, the retractable panel 150 retracts to accommodate the decreased distance between the first panel and the fixed panel. More specifically, movement of the first panel 110 drives the pivot block 180 along the elongate slots 192, which, in turn, drives the retractable panel 150 along the path of the U-shaped channels 194 so that some or all of the retractable panel retracts below the fixed panel 104. With the retractable panel 150 in the retracted position, only enough of the retracted panel required to transition from the first panel 110 to the fixed panel 104 remains exposed.

As the first panel 110 moves toward the fixed panel 104, the outer end 114 of the first panel pulls the upper end 132 of the second panel 130 to rotate the second panel in the clockwise direction (as viewed in FIG. 7) about axis 302. As the second panel 130 rotates, axis 300 moves downward along an arcuate path, thereby lowering the outer end 114 of the first panel 110. Lowering the outer end 114 of the first panel 110 causes the first panel to rotate about axis 304. The first and second panels 110 and 130 rotate until the operable ramp 100 reaches the lowered position of FIG. 8.

When the operable ramp 100 is in the lowered position, the first panel 110 and second panel 130 are approximately parallel and cooperate to provide an inclined transition surface between the fixed panel 104 and the first surface 62 shown in FIG. 3. Although the first and second panels 110 and 130 of the illustrated embodiment are approximately parallel in the lowered position, i.e., they form an angle of approximately 180° relative to each other, other embodiments are contemplated in which the first and second panels are not parallel in the lowered position. In this regard, embodiments are possible in which the first and second panels 110 and 130 form an angle in the range of 135° to 225°.

In the illustrated embodiment, the frame 102 includes a support 106 formed at the bottom of the frame. The exemplary support 106 is an inverted C-channel, but any suitable support configuration can be utilized. The support 106 is sized and configured to engage a stiffener 116 located on the lower side of the first panel 110 when the operable ramp 100 is in the lowered position. Thus, the support 106 provides additional support to the first panel 110 and, therefore, the second panel 130 when the ramp is in the lowered position. The support 106 provides improved ramp stability, and also prevents a sudden drop of the first panel 110 in the event of a power outage or drive system failure. It will be appreciated that the position, shape, and location of the support 106 can vary. In addition, more than one support can be utilized. These and other variations of the support 106 should be considered within the scope of the present disclosure.

Figure 8:
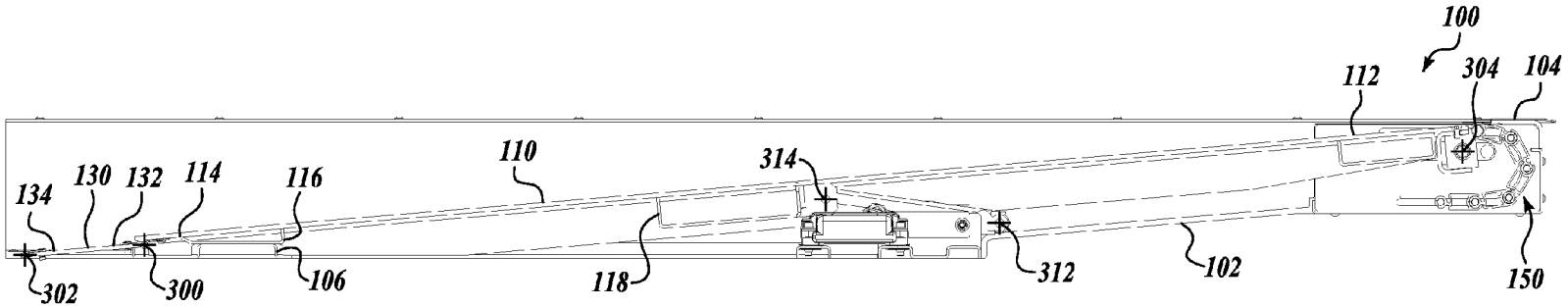
FIG. 8 shows a cutaway side view of the operable ramp of FIG. 5 in the lowered position.

To move the operable ramp 100 from the lowered position to the raised position, the motor 202 rotates the drive shaft 204 in a second direction (counterclockwise as viewed in FIG. 8). The drive shaft 204 rotates the drive link 212 about axis 310, which in turn drives the slave link 214. Movement of the slave link 214 drives the first panel 110 away from the fixed panel 104. Movement of the inner end 112 of the first panel 110 is controlled by the translation of the pivot block 180 along the elongate slots 192. Movement of the outer end 114 of the first panel 110 is controlled by the rotational attachment to the second panel 130 about axis 300, which moves upward along an arcuate path as the second panel rotates about axis 302.

As the first panel 110 moves away from the fixed panel 104, movement of the first panel 110 pulls the pivot block 180 away from the fixed panel. As the pivot block 180 moves away from the fixed panel 104, the pivot block pulls the retractable panel 150 into the extended position of FIG. 7. That is, the pivot block 180 pulls the retractable panel 150 along the path of the U-shaped channels 194 so that the retractable panel extends from the first panel 110 to the fixed panel 104. When in the extended position, the retractable panel 150 provides a transition surface between the first panel 110 and the fixed panel 104.

Rotation of the drive link 212 continues until the operable ramp 100 reaches the raised position of FIG. 7. In the raised position, the first panel 110 and retractable panel 150 cooperate to form a surface upon which able body persons can walk, and the second panel 130 extends downward from the outer end 114 of the first panel 110. Thus, the operable ramp 110 acts as a step between the first surface 62 and the second surface 64 of FIGS. 1 and 2.

Referring back to FIG. 6, a first gear 230 is coupled to the end of the drive shaft 204 such that rotation of the drive shaft rotates the first gear about axis 310. A second gear 232 is rotatably mounted to the frame 102 about an axis 316 parallel to axis 310. The second gear 232 engages the first gear 230 such that rotation of the first gear rotates the second gear, and conversely, rotation of the second gear rotates the first gear. The second gear 232 is accessible from above through a slot formed in the frame 102. During normal operation, a cover 234 is attached to the frame to cover the slot. In the event of a loss of power, the cover 234 can be removed, and an operator can manually rotate the second gear 232 to drive the linkage 210, thereby manually moving the operable ramp 100 between the raised position and the lowered position. In the illustrated embodiment, the second gear 232 includes a profiled arm onto which an operator inserts a bar to enable manual rotation of the second gear. In should be appreciated that any suitable configuration for manually rotating the second gear 232 can be employed. In this respect, the size, position, and configurations of mechanisms that transfer a manual input into rotation of the second gear 232 can vary, and such variations should be considered within the scope of the present disclosure.

While illustrative embodiments have been illustrated and described, it will be appreciated that various changes can be made therein without departing from the spirit and scope of the invention.

The embodiments of the invention in which an exclusive property or privilege is claimed are defined as follows:

1. An operable ramp moveable between a raised position and a lowered position, the operable ramp forming a step in the raised position, the operable ramp comprising:

(a) a first panel rotatably coupled at a first end about a first axis, the first axis moving in a first direction when the operable ramp moves toward the lowered position and in a second direction when the operable ramp moves toward the raised position;

(b) a second panel rotatably coupled at a first end to a second end of the first panel, the second panel extending downward from the first panel in the raised position and rotating about a fixed second axis when the operable ramp moves from the raised position to the lowered position, the first panel and the second panel cooperating to provide an inclined surface when the operable ramp is in the lowered position; and (c) a linkage operably coupled to the first panel, the linkage selectively rotating the first panel about the first axis.

2. The operable ramp of claim 1, the linkage comprising a first link selectively rotatable in a first direction and a second direction.

3. The operable ramp of claim 2, the linkage further comprising a second link rotatably coupled at a first end to the first link, a second end of the second link being rotatably coupled to the first panel.

4. The operable ramp of claim 1, further comprising a guide having an elongate slot, the first end of the first panel slidingly engaging the elongate slot.

5. The operable ramp of claim 1, further comprising a third panel, rotatably associated with the first end of the first panel, movement of the first axis in the first direction moving a first end of the third panel.

6. The operable ramp of claim 5, the third panel providing a surface between the first panel and a fixed panel when the operable ramp is in the raised position.

7. The operable ramp of claim 6, at least a portion of the third panel being disposed beneath the fixed panel when the operable ramp is in the lowered position.

8. The operable ramp of claim 5, the third panel comprising a plurality of members rotatably coupled in seriatim.

9. The operable ramp of claim 8, the third panel being operably associated with a channel, the channel guiding movement of the third panel when the operable ramp moves from the raised position to the lowered position.

10. The operable ramp of claim 9, the channel being a U-shaped channel.

11. An operable ramp moveable between a raised position and a lowered position, the operable ramp forming a step in the raised position, the operable ramp comprising:

(a) a first panel rotatably coupled at a first end about a first axis, the first axis moving in a first direction when the operable ramp moves toward the lowered position and in a second direction when the operable ramp moves toward the raised position;

(b) a second panel rotatably coupled at a first end to a second end of the first panel, the second panel extending downward from the first panel in the raised position and rotating about a fixed second axis when the operable ramp moves from the raised position to the lowered position, the first panel and the second panel cooperating to provide an inclined surface when the operable ramp is in the lowered position; and (c) a third panel rotatably associated with the first end of the first panel, the third panel providing a surface between the first panel and a fourth panel.

12. The operable ramp of claim 11, the fourth panel being a fixed panel.

13. The operable ramp of claim 11, the first end of the first panel moving the third panel when the operable ramp moves toward the lowered position.

14. The operable ramp of claim 11, at least a portion of the third panel being disposed beneath the fourth panel when the operable ramp is in the lowered position.

15. The operable ramp of claim 11, the third panel comprising a plurality of members rotatably coupled in seriatim.

16. The operable ramp of claim 15, the third panel being operably associated with a channel, the channel guiding movement of the third panel when the operable ramp moves from the raised position to the lowered position.

17. The operable ramp of claim 16, the channel being a U-shaped channel.

18. The operable ramp of claim 11, further comprising a linkage operably coupled to the first panel, the linkage selectively rotating the first panel about the first axis.

* * * * *